US007241167B2

(12) United States Patent
Yamada et al.

(10) Patent No.: US 7,241,167 B2
(45) Date of Patent: Jul. 10, 2007

(54) CONNECTOR

(75) Inventors: Akio Yamada, Tokyo (JP); Takuya Higeta, Tokyo (JP)

(73) Assignee: DDK Ltd., Tokyo (JP)

( * ) Notice: Subject to any disclaimer, the term of this patent is extended or adjusted under 35 U.S.C. 154(b) by 317 days.

(21) Appl. No.: 10/726,204

(22) Filed: Dec. 2, 2003

(65) Prior Publication Data

US 2004/0127092 A1 Jul. 1, 2004

(30) Foreign Application Priority Data

Dec. 26, 2002 (JP) ..... 2002-376154
Sep. 30, 2003 (JP) ..... 2003-339092

(51) Int. Cl.
*H01R 12/24* (2006.01)

(52) U.S. Cl. ..... 439/498; 439/260; 439/329; 439/298

(58) Field of Classification Search ..... 439/290, 439/298, 61, 329, 260, 632, 680, 495–498
See application file for complete search history.

(56) References Cited

U.S. PATENT DOCUMENTS 4,684,183 A * 8/1987 Kinoshita et al. ..... 439/77
4,824,391 A * 4/1989 Ii ..... 439/329
4,959,030 A * 9/1990 Tatebe et al. ..... 439/67
4,975,068 A * 12/1990 Squires ..... 439/67
5,163,847 A * 11/1992 Regnier ..... 439/157
5,276,817 A * 1/1994 Matschke et al. ..... 439/61
5,350,319 A * 9/1994 Roberts ..... 439/632
5,928,029 A * 7/1999 Lam ..... 439/497
6,247,951 B1 * 6/2001 Di Liello et al. ..... 439/329
6,508,661 B1 * 1/2003 Yu ..... 439/495
6,722,915 B1 * 4/2004 McAlonis et al. ..... 439/498
6,773,288 B2 * 8/2004 Geltsch et al. ..... 439/329

* cited by examiner

*Primary Examiner*—Truc Nguyen
(74) *Attorney, Agent, or Firm*—Baker Botts LLP

(57) ABSTRACT

A connector includes a housing and a required number of pusher members. The housing has a fitting aperture into which two or at least three flexible printed circuit boards are inserted and insertion openings for holding the required number of the pusher members. When the two or at least three flexible printed circuit boards are inserted into the fitting aperture of the housing, contact portions of the two or at least three flexible printed circuit boards are urged by the pusher members so as to be connected to each other to achieve electrical continuity of the connector. With this construction, the connector can be mounted on anywhere with the exception of a flexible printed circuit board as by adhesion or pushing down by a frame of the set without using soldering, thereby permitting low cost manufacture and wide freedom of selection of connector mechanisms.

14 Claims, 6 Drawing Sheets

CONNECTOR

BACKGROUND OF THE INVENTION

The present invention relates to a connector for use in miniature electronic appliances such as terminal equipment of cellular or portable telephones, and more particularly to a connector using flexible printed circuit boards adapted to be electrically connected in a simple manner.

In general, a connector includes a required number of contacts and a housing fixing therein said contacts and having a fitting aperture into which a flexible printed circuit board is inserted. These contacts are fixed to the housing by press-fitting, lancing or hooking or the like. In the case of two flexible printed circuit boards to be connected, connection portions of contacts of such a connector are fixed to one flexible printed circuit board as by soldering. When the other printed circuit board is inserted into the fitting aperture of the housing, the other flexible printed circuit board is connected to contact portions of the contacts of the connector, thereby achieving electrical continuity of the two flexible printed circuit boards.

The miniature electronic appliances such as terminal equipment of portable telephones have been developed to increase their functions, while at the same time such electronic appliances have been even more miniaturized so that spaces given to their inner components have been surprisingly reduced.

In order to solve this problem, one attempt has been made to form a connector having thin walls to provide a space therein as wide as possible. However, such a connector suffers a disadvantage from the fact that it may be warped due to heating during soldering process. On the other hand, the increased functions of the appliances would involve increased soldering steps in manufacturing processes which would inhibit desired reduction of manufacturing cost. As a result of employing soldering as fixing means, there is no area for mounting the connector other than a flexible printed circuit board, limiting freedom of selection of connector mechanisms.

Moreover, there is a case that without using a connector a flexible printed circuit board is directly connected to a mating circuit board by soldering or, in particular, by the use of ACF (anisotropic conductive film). In such a case, however, disassembling for required maintenance would become impossible which is inconvenient.

SUMMARY OF THE INVENTION

It is an object of the invention to provide a connector which eliminates all the disadvantages of the prior art described above and can be mounted on anywhere other than a flexible printed circuit board (as by adhesion, or pushing down by a frame of the set) without using soldering, thereby permitting significantly low cost manufacture and widening freedom of selection of connector mechanisms.

In order to achieve this object, the connector according to the invention comprises a housing and a required number of pusher members, the housing including a fitting aperture into which at least three flexible printed circuit boards are inserted, the housing further including insertion openings for holding the required number of pusher members so that when the flexible printed circuit boards are inserted into the fitting aperture of the housing, contact portions of the at least three flexible printed circuit boards are urged by the pusher members so as to be connected to each other to achieve electrical continuity of the connector.

In another aspect of the invention for accomplishing the above object, the connector comprises a housing and a required number of pusher members, the housing including a fitting aperture into which two flexible printed circuit boards are inserted, the housing further including insertion openings for holding the required number of pusher members so that when the flexible printed circuit boards are inserted into the fitting aperture of the housing, contact portions of the two flexible printed circuit boards are urged by the pusher members so as to be connected to each other to achieve electrical continuity of the connector.

The term "a required number" of pusher members as used in this specification and claims is to be understood to mean the number of the pusher members required to perform the pusher member's function, so that the required number may be one or plural so long as the function is fulfilled.

The contact portions of two or at least three flexible printed circuit boards are preferably arranged in opposition to each other such that the contact portions can be connected on being urged against each other by the required number of pusher members. Such an arrangement of the contact portions in opposition to each other ensures electrical connection of these portions being urged with great certainty.

In a preferred embodiment, the connector is provided with positioning means for the flexible printed circuit boards, thereby achieving reliable connection between the contact portions of the circuit boards. The positioning means comprises flanges at longitudinal ends of the housing, each of the flanges being provided with a pin, and the flexible printed circuit boards are formed with apertures for receiving the pins such that when the pins are received in the apertures of the flexible printed circuit boards, the contact portions of the flexible printed circuit boards positionally coincide with each other.

In one embodiment, at least three flexible printed circuit boards are each formed with slits between the adjacent contact portions or between pairs of each two adjacent contact portions or between contact portions arbitrarily selected to provide a compliance to these contact portions. By providing such slits, there is no longer any risk of mating contact portions being not or incompletely in contact with each other due to variances in height of the contact portions. In this manner, the contact portions of at least three flexible printed circuit boards can be securely connected to each other.

In a further embodiment, either, or both, of two flexible printed circuit boards are each formed with slits between the contact portions or between pairs of two adjacent contact portions or between contact portions arbitrarily selected to provide a compliance to these contact portions. By providing such slits, there is no longer any risk of mating contact portions being not or incompletely in contact with each other due to variances in height of the contact portions. The contact portions of the two flexible printed circuit boards can be certainly connected to each other in this manner.

Preferably, the pusher members have substantially a U-shape. With this shape, the two flexible printed circuit boards are embraced by two arms of the U-shaped pusher members to connect the contact portions of the two flexible printed circuit boards reliably. Pushing portions of the pusher members preferably extend toward the flexible printed circuit boards, thereby enabling the two boards to be urged against each other.

The subject feature of the invention lies in the pusher members which are able to urge with their pushing portions the flexible printed circuit boards to connect the contact portions of the circuit boards to each other so as to achieve the electrical continuity of the connecter by merely inserting the circuit boards into the fitting aperture of the housing of the connector.

As can be seen from the above description, the connector according to the invention can bring about the following significant functions and effects.

(1) The connector according to the invention comprises a required number of pusher members and a housing having a fitting aperture for receiving two or at least three flexible printed circuit boards inserted therein and insertion openings holding the pusher members so that when the flexible printed circuit boards are inserted into the fitting aperture, the circuit boards are urged by the pusher members so as to cause contact portions of the circuit boards to be connected to each other to achieve electrical continuity of the connector. With this construction, there is no need for soldering in manufacture and the connector can be located anywhere with the exception of circuit boards (by means of an adhesive or pushing down by a frame of the set without using soldering), thereby lowering manufacturing cost and widening freedom of design of connector mechanisms.

(2) According to the invention at least three flexible printed circuit boards are each formed with slits between adjacent contact portions or between pairs of each two adjacent contact portions or between contact portions arbitrarily selected, thereby providing flexibility to these contact portions.

(3) According to the invention at least three flexible printed circuit boards are each formed with slits between adjacent contact portions or between each pair of two adjacent contact portions or between contact portions arbitrarily selected to provide a compliance to these contact portions. Consequently, the contact portions of these circuit boards can be reliably connected electrically to each other even if there are variances in height of the contact portions of the circuit boards. Soldering is not required, and stable connection and easy positioning are possible.

(4) According to the invention either, or both, of two flexible printed circuit boards are formed with slits between adjacent contact portions, or between pairs of two adjacent contact portions or between contact portions arbitrarily selected, thereby providing flexibility to these contact portions of the circuit boards.

(5) According to the invention either, or both, of two flexible printed circuit boards are formed with slits between adjacent contact portions, or between pairs of two adjacent contact portions or between contact portions arbitrarily selected to provide a compliance to these contact portions. Therefore, the contact portions of these circuit boards can be connected to each other with certainty, despite the fact that there may be variances in height of the contact portions of the circuit boards. It is thus achieved that there is no need to use soldering in manufacture, and it is also achieved to obtain stable connection and easy positioning.

(6) According to the invention, the contact portions of two or at least three flexible printed circuit boards are arranged oppositely each other so that the contact portions can be connected electrically when the circuit boards are urged against each other by means of the pusher members. Therefore, by merely inserting these circuit boards into the fitting aperture of the housing of the connector, the contact portions can be readily connected to each other to obtain a stable connection of the circuit boards.

(7) According to the invention the pusher members are substantially U-shaped having two arms which will embrace therebetween two or at least three flexible printed circuit boards to obtain a stable connection therebetween without using soldering.

(8) The pusher members used in the connector according to the invention each includes pushing portions extending toward the circuit boards so that when the circuit boards are inserted into the fitting aperture of the housing of the connector, these circuit boards are pushed toward each other by the inwardly extending pusher members to obtain a stable connection of the circuit boards without using soldering.

(9) According to the invention the connector is provided on the housing with positioning means for the flexible printed circuit boards, thereby securely connecting the contact portions of these circuit boards.

(10) According to the invention the positioning means for the flexible printed circuit boards comprises flanges at both longitudinal ends of the housing, each of the flanges being provided with a pin. On the other hand, the flexible printed circuit boards are each formed with apertures at locations corresponding to the pins such that when the pins are received in the aperture of the circuit boards, the contact portions of the circuit boards positionally coincide with each other. Therefore, the contact portions of the circuit boards can be connected to each other with great certainly.

The invention will be more fully understood by referring to the following detailed specification and claims taken in connection with the appended drawings.

DESCRIPTION OF THE PREFERRED EMBODIMENTS

Figure 1:
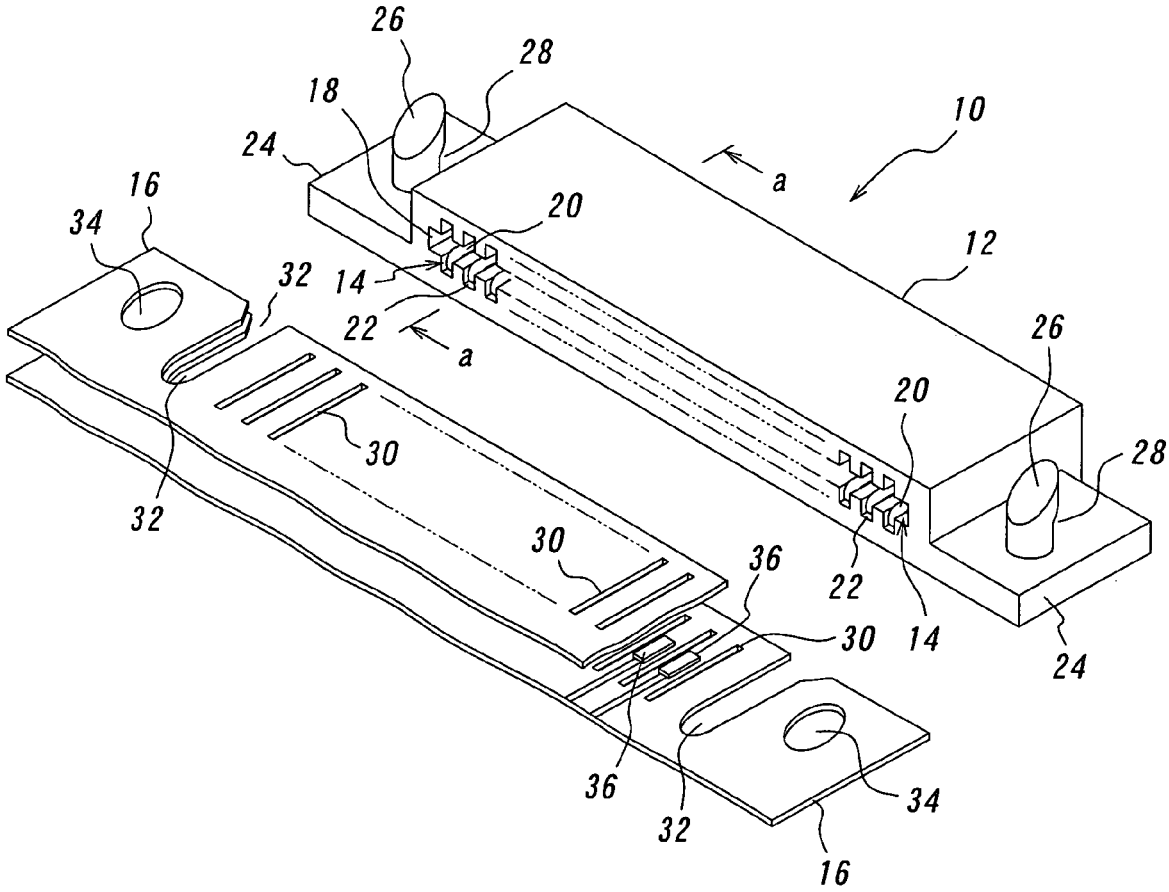
FIG. 1 is a perspective view of a connector according to the invention and flexible printed circuit boards viewed from the side of its fitting aperture.
Figure 2A:
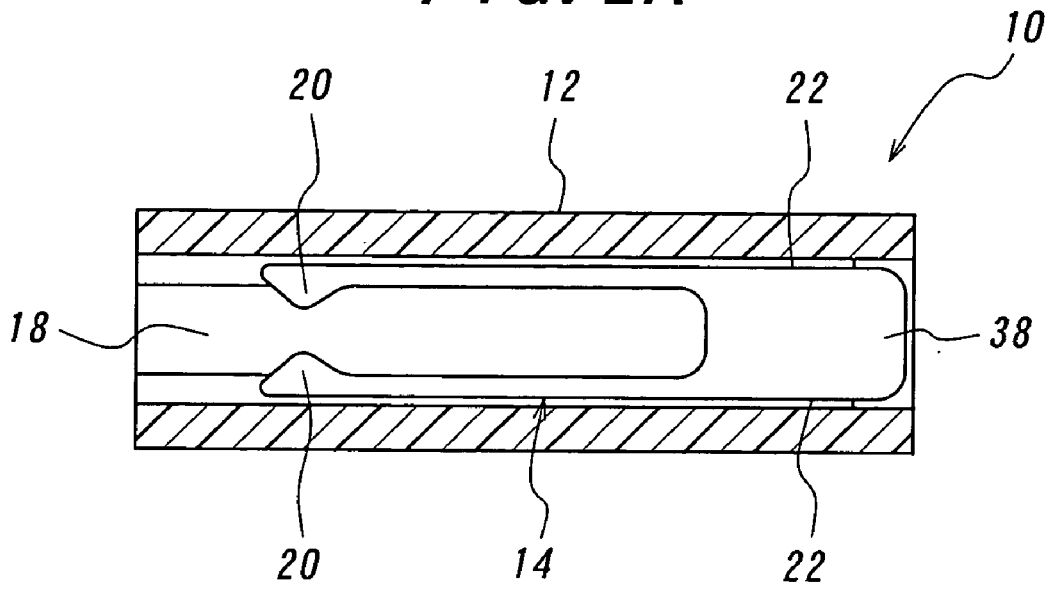
FIG. 2A is a cross-sectional view of the connector taken along a line a-a in FIG. 1 prior to insertion of flexible printed circuit boards.
Figure 2B:
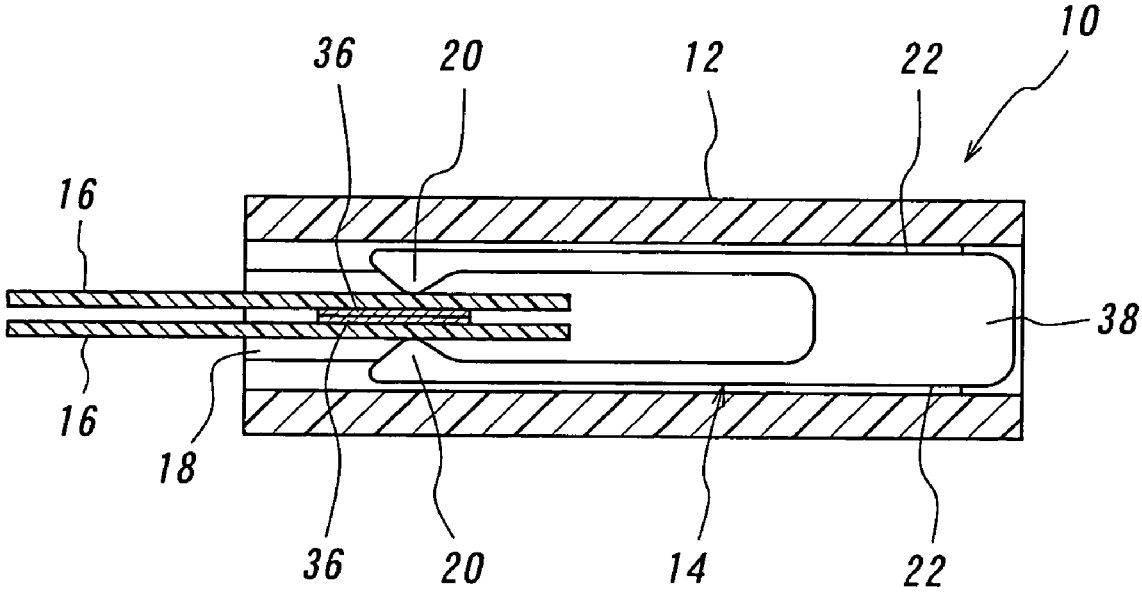
FIG. 2B is a cross-sectional view similar to FIG. 2A but with the circuit boards inserted in the connector.
Figure 3A:
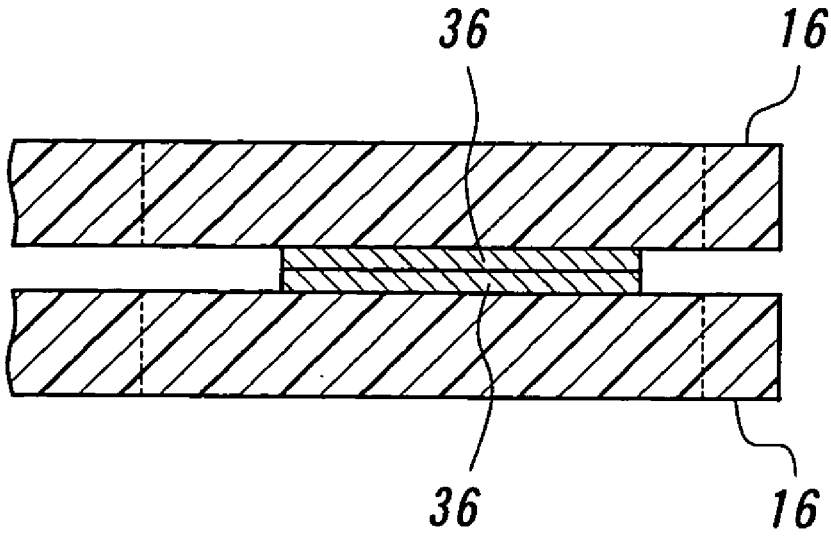
FIG. 3A is a cross-sectional view of the circuit boards taken along a line between two slits, with contact portions being connected.
Figure 3B:
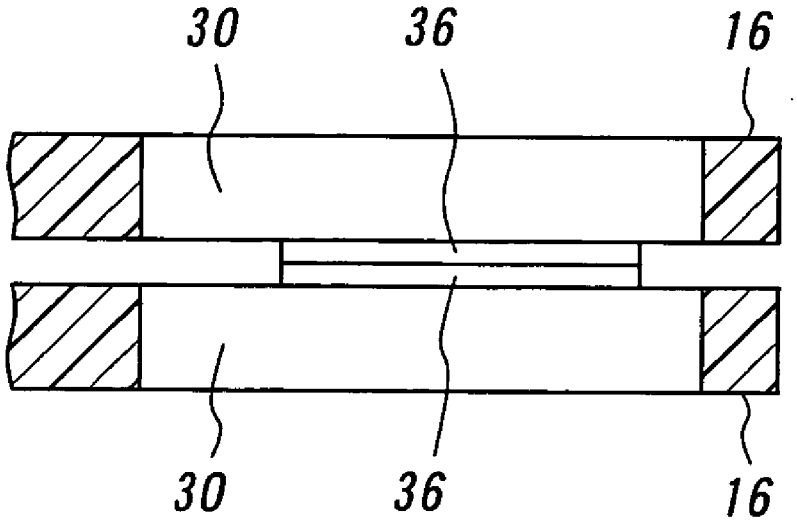
FIG. 3B is a cross-sectional view of the circuit boards taken along one slit, with contact portions being connected.
Figure 4:
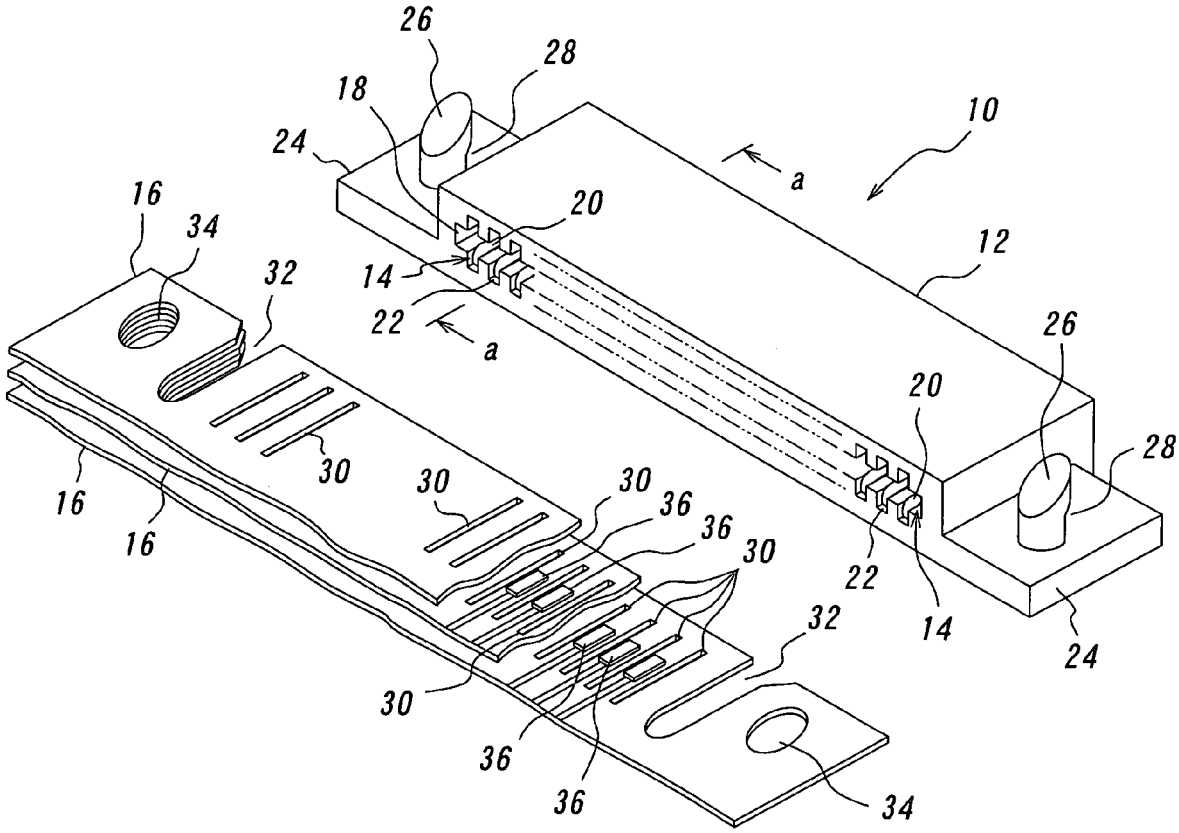
FIG. 4 is a perspective view of a connector according to the invention into which three flexible printed circuit boards are about to be inserted.
Figure 5:
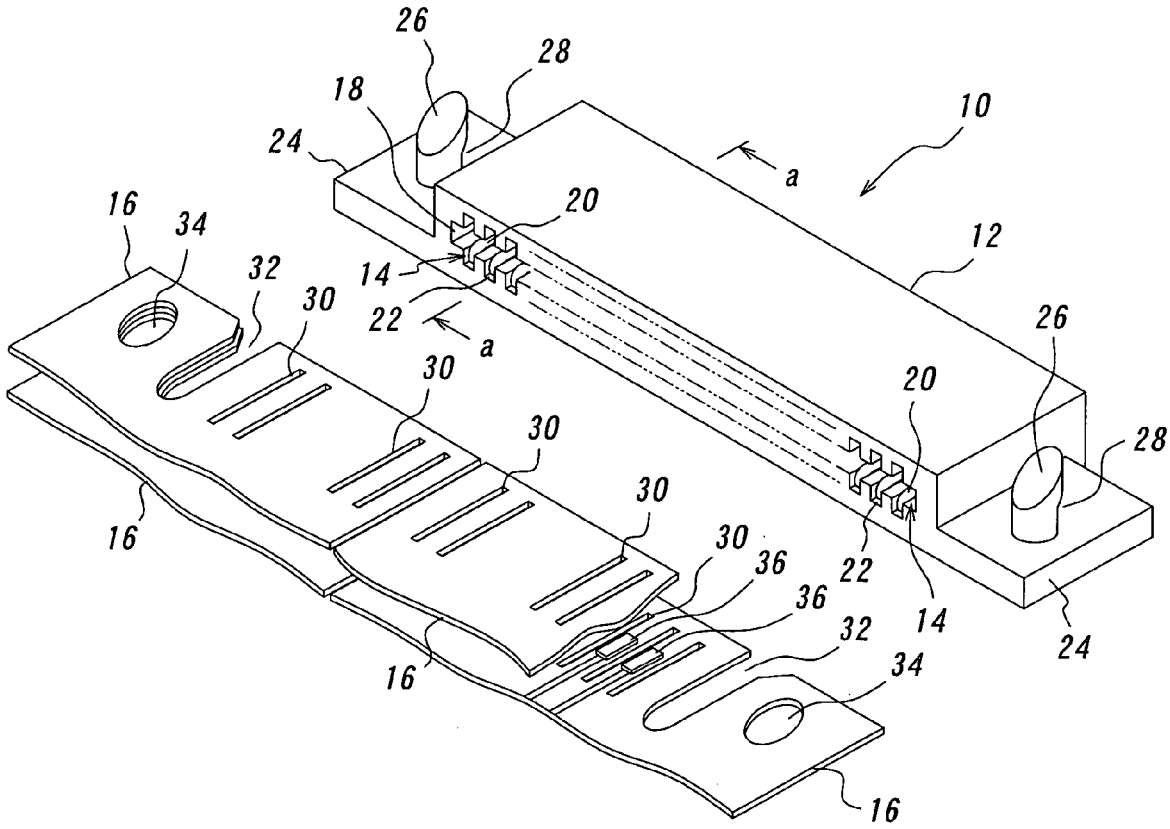
FIG. 5 is a perspective view of a connector according to the invention into which four flexible printed circuit boards are about to be inserted.
Figure 6:
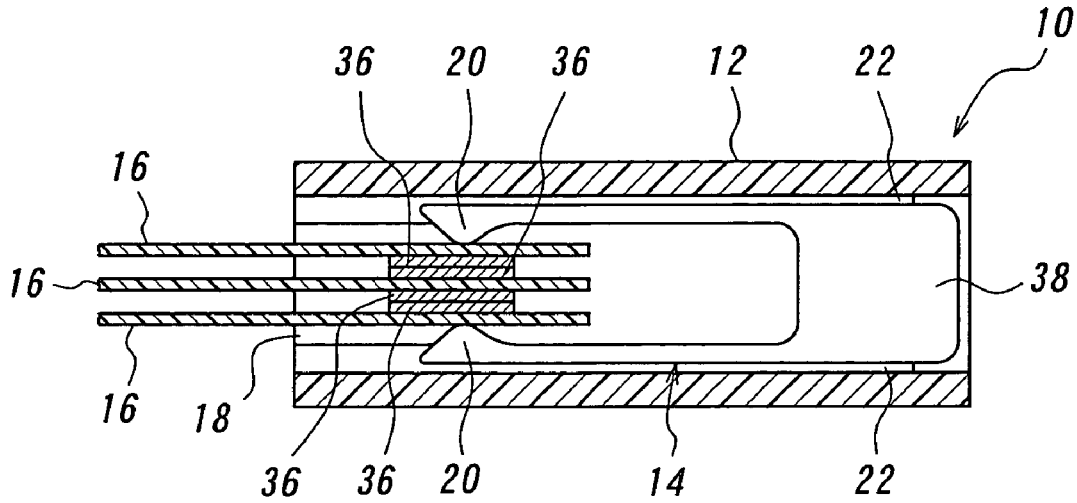
FIG. 6 is a sectional view of the connector taken along a line a-a in FIG. 4 after the circuit boards have been inserted.
Figure 7:
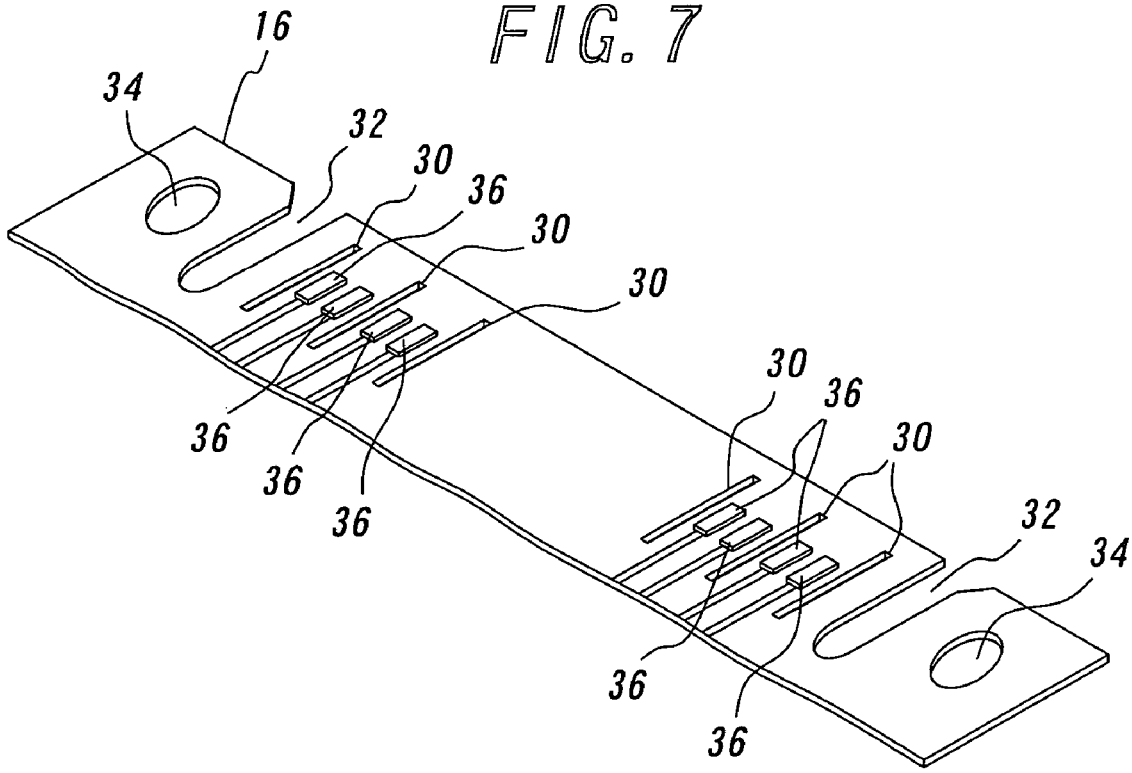
FIG. 7 is a perspective view of a flexible printed circuit board formed with slits at locations different from those already illustrated.

One exemplary connector according to the present invention will be explained by referring to the drawings. FIG. 1 illustrates in a perspective view the connector according to the invention, whose cross-section taken along a line a-a in FIG. 1 is shown in FIG. 2A before insertion of flexible printed circuit boards, while FIG. 2B illustrates the similar cross-section, with the flexible printed circuit boards inserted therein. FIGS. 3A and 3B illustrate two flexible printed circuit boards with their contact portions being connected in cross-sections taken along a line between slits and taken along one of the slits, respectively. FIGS. 4 and 5 show in perspective views a connector according to the invention adapted to receive three and four flexible printed circuit boards, respectively. FIG. 6 is a cross-section taken along a line a-a in FIG. 4 illustrating a state of the connector with the circuit boards inserted therein. FIG. 7 illustrates in a perspective view part of a flexible printed circuit board formed with slits at varied locations.

The connector 10 according to the invention mainly comprises a housing 12 and a plurality of pusher members 14. The connector in the illustrated embodiment has a configuration capable of connecting contact portions 36 of the plural number of flexible printed circuit boards 16 merely by inserting these circuit boards 16 into the housing 12. Components of the connector according to the invention will be explained in detail referring to the drawings.

The housing 12 is injection molded in the conventional manner from an electrically insulating plastic material. Preferred materials from which to form the housing 12 include polybutylene terephthalate (PBT), polyamide (66 PA or 46 PA), liquid crystal polymer (LCP), polycarbonate (PC) and the like and combination thereof in view of the requirements imposed on the housing with respect to dimensional stability, workability, manufacturing cost and the like.

The housing 12 is formed with a fitting aperture 18 into which the plural number of flexible printed circuit boards 16 are inserted through its open end, and insertion openings 22 in which a required number of pusher members 14 are inserted and fixed thereat by press-fitting, lancing or hooking, welding or the like in a manner such that pushing portions 20 of the pusher members 14 extend into the interior of the fitting aperture 18. The insertion openings 22 are formed in the housing 12 such that the pushing portions 20 of the pusher members 14 received in the insertion openings 22 positionally correspond to the contact portions 36 of the flexible printed circuit boards 16 inserted in the housing 12. The insertion openings 22 are also sized in design to securely fix and retain the pusher members 14 in consideration of the strength of the housing and the size of the pusher members 14 themselves. The fitting aperture 18 of the housing 12 may be sized to be able to receive the plural number of flexible printed circuit boards on the basis of the dimension of the flexible printed circuit boards.

The housing 12 is provided with positioning means for positioning and fixing the flexible printed circuit boards 16. The positioning means may comprise flanges 24 at both longitudinal ends of the housing 12, on each of which is provided with a pin 26 for positioning the circuit boards 16. The pins 26 may be formed integrally with or formed separately from the housing 12, depending upon targeted manufacturing cost and workability of the housing. The pins 26 may be formed with a notch 28 for preventing the circuit boards 16 from being dislodged from the pins as shown in FIG. 1. However, pins 26 not having a notch 28 are more preferable for accurate positioning of the contact portions 36 of the circuit boards 16 and suffice to fix and hold the circuit boards. The pins 26 may be of circular cylinder, rectangular column or the like so long as they can perform positioning, fixing and holding of the flexible printed circuit boards.

The pusher members 14 serve to urge more than two flexible printed circuit boards 16 so as to bring about the contact portions 36 of the circuit boards 16 into contact with each other when these circuit boards are inserted into the fitting aperture of the housing 12. The fundamental difference of the pusher members 14 from usual contacts is that no electric signals flow therethrough. Therefore, the pusher members 14 may be made of either a metal or plastic material so long as they can perform their functions described above. However, the pusher members 14 may be preferably made of a metal in consideration of times of insertion and removal of the circuit boards and springiness which may be required. The pusher members 14 made of a metal are formed by press-working. Preferred materials for the pusher members include brass, beryllium copper, phosphor bronze and the like to fulfil the requirements imposed thereon, springiness, easiness in insertion and removal of circuit boards and the like. When a plastic material is used for the pusher members, the insulating plastic material for the housing 12 may be used.

The pusher member 14 mainly comprises pushing portions 20 for urging the circuit boards 16 and a fixing portion 38 for fixing the pusher member 14 to the housing 12. The pushing portions 20 of the pusher members 14 are in the form of a projection and extend toward each other so as to urge the circuit boards inwardly with ease. In the illustrated embodiment, the pusher members 14 are substantially of a U-shape and fitted in the housing so that the pushing portions 20 correspond to the contact portions 36 of the circuit boards 16 inserted in the housing 12. Therefore, the pushing portions 20 of the pusher members 14 are in opposition to each other and embrace two or at least three circuit boards 16 therebetween. The spacing between the opposed pushing portions 20 of the pusher members 14 is suitably so designed as to bring about the contact portions 36 of the two or at least three circuit boards 16 into contact with each other when these circuit boards 16 have been inserted.

While the pushing portions 20 of the pusher members 14 are arranged in opposition to each other in the illustrated embodiment, it will be apparent that the pusher members 14 may have only one pushing portion 20 in so far as they can perform their functions. However, it is preferable to provide the pushing portions 20 in opposition to each other for the complete connection between the contact portions 36 of the circuit boards 16.

Although the number of the pusher members 14 corresponds to that of contact portions 36 of the circuit boards 16 in the illustrated embodiment, it is to be understood that only one pusher member 14 may be provided so long as it serves to perform the function commensurate with those of a plurality of pusher members 14. The term "one" is here understood as signifying one pusher member consisting of some pusher members integrally formed. It may also be a unitary member consisting of all the pusher members corresponding to the contact portions of the circuit boards. Therefore, the term "a required number" of pusher members used herein includes the pusher members of the number corresponding to the contact portions of the circuit boards, a plurality of pusher members each being a unitary member consisting of some pusher members, and a single pusher member formed integrally of all the pusher members of the number corresponding to that of all the contact portions of the circuit boards.

Finally, the flexible printed circuit boards will be explained in detail. The connector 10 according to the invention achieves its electrical connection by pushing the contact portions 36 of two or at least three flexible printed circuit boards 16 against each other by the pusher members 14. Therefore, the connector according to the invention is characterized in the feature of connecting two or at least three flexible printed circuit boards by the use of these circuit boards themselves. The contact portions 36 of the two or at least three flexible printed circuit boards are arranged in opposition to each other so that merely by inserting these circuit boards into the fitting aperture 18 of the housing 12, these contact portions 36 are connected to each other.

When the flexible printed circuit boards are inserted into the fitting aperture 18 of the housing 12, there may be a risk that the mating contact portions are not or incompletely in contact with each other due to variances in height of the contact portions. In order to avoid this problem, the flexible printed circuit board 16 is formed with a required number of slits 30 between the contact portions 36 or between pairs of each two adjacent contact portions as shown in FIG. 7 or between the contact portions arbitrarily selected to provide a compliance or flexibility to these contact portions, thereby ensuring complete connection between the opposed contact portions of the circuit boards even if there are somewhat variances in height of the contact portions. In the embodiments shown in FIGS. 1, 4 and 5, slits 30 are provided between the contact portions 36 so that the number of the slits 30 is one less than the number of the contact portions 36.

As describe above with FIG. 7, the slits 30 are provided between pairs of each two adjacent contact portions 36 of the circuit boards 16. Moreover, the slits 30 may be provided only between arbitrarily selected contact portions of the circuit boards (not shown). The size of the slits 30 may be suitably designed in consideration of the strength of the circuit boards and complete connection of the contact portions of two or at least three flexible printed circuit boards. The slits may extend in a manner completely passing through the thickness of the circuit board, or in another case they may be formed as grooves having a bottom so long as they can provide a required compliance. The slits may be designed in consideration of the flexibility and workability of the circuit boards. The slits in the illustrated embodiments extend through the thickness of the circuit boards.

The following cases can be considered as to the term "two or at least three circuit boards". As shown in FIG. 1, two flexible printed circuit boards are inserted into the fitting aperture 18 of the housing 12. In the case shown in FIG. 4, three flexible printed circuit boards are inserted into the fitting portion of the fitting aperture 18 of the housing 12. In the case shown in FIG. 5, two boards one above the other on the left and further two boards one above the other on the right, that is, four boards 16 are inserted into the fitting aperture 18 of the housing 12. More than four boards may be possible (not shown). For example, at least two groups each consisting of at least three circuit boards arranged one above the other may be arranged side by side.

In the case as shown in FIG. 5 provided with the plurality of circuit boards on the left and right, it is preferable to provide further positioning means in the proximity of adjacent ends of the circuit boards on the left and right. For example, adjacent ends of the circuit boards 16 on the left and right are formed with apertures or grooves and the housing 12 is also formed with apertures at locations corresponding to the apertures or grooves of the circuit boards upon being inserted in the housing 12, whereby after the circuit boards have been inserted into the fitting aperture 18 of the housing 12, pins are inserted into the corresponding apertures or grooves of the circuit boards and the housing 12 to achieve the positioning of the circuit boards.

Returning to the positioning means including the flanges 24 and the pins 26 described above, the flexible printed circuit boards 16 are each formed with apertures 34 at locations corresponding to the pins 26, so that the engagement of the pins 26 and the apertures 34 ensures the positioning of the circuit boards 16. The apertures 34 may be of any shape, circular or elliptical so long as they can perform their function. The circuit boards 16 are each further formed with relief slits 32 to avoid any interference with walls of the housing 12. The relief slits 32 may be of any shape so long as it prevents the interference with the housing 12 and may be suitably designed in consideration of the workability of the circuit board.

The most preferable application of the present invention is, but is not limited to, a connector with flexible printed circuit boards for use with miniature electronic appliances such as terminal equipment of portable telephones.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector comprising a housing and a required number of pusher members, said housing including a fitting aperture into which at least three flexible printed circuit boards are inserted, said housing further including an insertion opening for holding said required number of pusher members so that when said flexible printed circuit boards are inserted into said fitting aperture of said housing, contact portions of said at least three flexible printed circuit boards are urged by two cantilever arms of said pusher members so as to be connected to each other to achieve electrical continuity of the connector, wherein said pusher members have substantially a U-shape and are formed of a unitary part and said pusher members each comprise pushing portions extending towards the flexible printed circuit boards;

wherein the pusher members are entirely enclosed within the housing.

2. A connector comprising a housing and a required number of pusher members, said housing including a fitting aperture into which two flexible printed circuit boards are inserted, said housing further including insertion openings for holding said required number of pusher members so that when said flexible printed circuit boards are inserted into said fitting aperture of said housing, contact portions of said two flexible printed circuit boards are urged by two cantilever arms of said pusher members so as to be connected to each other to achieve electrical continuity of the connector, wherein said pusher members have substantially a U-shape and are formed of a unitary part and said pusher members each comprise pushing portions extending towards the flexible printed circuit boards;

wherein the pusher members are entirely enclosed within the housing.

3. The connector as set forth in claim 1 wherein said contact portions of said at least three flexible printed circuit boards are arranged in opposition to each other such that said contact portions can be connected on being urged against each other by said pusher members.

4. The connector as set forth in claim 2 wherein said contact portions of said two flexible printed circuit boards are arranged in opposition to each other such that said contact portions can be connected on being urged against each other by said pusher members.

5. The connector as set forth in claim 3 or 4 further comprising positioning means for said flexible printed circuit boards.

6. The connector as set forth in claim 5 wherein said at least three flexible printed circuit boards are each formed with slits between the adjacent contact portions.

7. The connector as set forth in claim 5 wherein either, or both, of said flexible printed circuit boards are each formed with slits between the contact portions.

8. The connector as set forth in claim 5 wherein said at least three flexible printed circuit boards are formed with slits between each pair of two adjacent contact portions.

9. The connector as set forth in claim 5 wherein either, or both, of said flexible printed circuit boards are formed with slits between pairs of each two adjacent contact portions.

10. The connector as set forth in claim 5 wherein said at least three flexible printed circuit boards are each formed with slits between the adjacent contact portions arbitrarily selected to provide a compliance to said adjacent contact portions.

11. The connector as set forth in claim 5 wherein either, or both, of said flexible printed circuit boards are each formed with slits between the adjacent contact portions arbitrarily selected to provide a compliance to said adjacent contact portions.

12. The connector as set forth in claim 6 wherein said positioning means comprises flanges at longitudinal ends of said housing, each of said flanges being provided with a pin, and said flexible printed circuit boards are formed with apertures for receiving said pins such that when said pins are received in said apertures of said flexible printed circuit boards, said contact portions of said flexible printed circuit boards positionally coincide with each other.

13. The connector as set forth in claim 4 further comprising positioning means for said flexible printed circuit boards.

14. The connector as set forth in claim 11 wherein said positioning means comprises flanges at longitudinal ends of said housing, each of said flanges being provided with a pin, and said flexible printed circuit boards are formed with apertures for receiving said pins such that when said pins are received in said apertures of said flexible printed circuit boards, said contact portions of said flexible printed circuit boards positionally coincide with each other.

* * * * *